US010814365B2

(12) United States Patent
Gantzer et al.

(10) Patent No.: US 10,814,365 B2
(45) Date of Patent: Oct. 27, 2020

(54) SYSTEMS AND METHODS FOR COOLING A ROLL IN METAL PROCESSING

(71) Applicant: Novelis Inc., Atlanta, GA (US)

(72) Inventors: David Edward Gantzer, Woodstock, GA (US); Timothy F. Stanistreet, Kennesaw, GA (US); Robert William Mallory, Dallas, GA (US); Renato Rufino Xavier, Kennesaw, GA (US); James Charles Riggs, Acworth, GA (US); Frank Su, Smyrna, GA (US); David Skingley Wright, Rosdorf-Dramfield (DE)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 16/440,688

(22) Filed: Jun. 13, 2019

(65) Prior Publication Data

US 2019/0381546 A1 Dec. 19, 2019

Related U.S. Application Data

(60) Provisional application No. 62/684,443, filed on Jun. 13, 2018.

(51) Int. Cl.

| | |
|---|---|
| ***B21B 27/10*** | (2006.01) |
| ***B21B 28/04*** | (2006.01) |
| ***B21B 31/07*** | (2006.01) |

(52) U.S. Cl.

CPC ..... *B21B 27/10* (2013.01); *B21B 28/04* (2013.01); *B21B 31/076* (2013.01); *B21B 31/078* (2013.01); *B21B 2027/103* (2013.01)

(58) Field of Classification Search

CPC . B21B 27/10; B21B 2027/103; B21B 72/201; B21B 72/236; B21B 45/0269;

(Continued)

(56) References Cited

U.S. PATENT DOCUMENTS 3,200,629 A 8/1965 James et al.
4,458,376 A * 7/1984 Sitko ..... B21B 45/0278 118/126

(Continued)

FOREIGN PATENT DOCUMENTS

DE 2038873 B 12/1971
DE 102009053073 A1 9/2010

(Continued)

OTHER PUBLICATIONS

English translate (JPH105827A), retrieved date Apr. 16, 2020.*

(Continued)

*Primary Examiner* — Adam J Eiseman

*Assistant Examiner* — Mohammed S. Alawadi

(74) *Attorney, Agent, or Firm* — Kilpatrick Townsend & Stockton LLP

(57) ABSTRACT

Provided herein are systems and methods for containing a viscous material, such as coolant, applied to cool a roll or a roll processed engineering material such as a metal strip. In particular, a viscous material containment system can include a housing, a viscous material delivery system, a plurality of movable seals and a plurality of gas delivery devices. A method for cooling a roll can include applying a vicious material, such as coolant, to the roll and containing the viscous material on the roll using the viscous material containment system. In some cases, the viscous material containment system can be used to facilitate removal of the viscous material from the roll.

20 Claims, 3 Drawing Sheets

(58) Field of Classification Search
CPC ..... B21B 45/0275; B21B 45/0278; B21B 45/0281; B21B 45/0284; B21B 45/029; B21B 45/0293; B21B 45/0296
USPC ..... 72/201, 236
See application file for complete search history.

(56) References Cited

U.S. PATENT DOCUMENTS

| | | | | | |
|---|---|---|---|---|---|
| 4,601,112 | A | | 7/1986 | Kush et al. | |
| 4,691,549 | A | * | 9/1987 | Adair | B21B 27/10 72/201 |
| 4,718,264 | A | * | 1/1988 | Guppy | B21B 27/10 72/201 |
| 4,796,450 | A | * | 1/1989 | Blazevic | B21B 39/16 72/201 |
| 4,934,444 | A | * | 6/1990 | Frischknecht | B21B 27/08 164/480 |
| 5,524,465 | A | | 6/1996 | Kajiwara et al. | |
| 5,628,223 | A | * | 5/1997 | Denker | B21B 45/0278 72/236 |
| 2009/0255782 | A1 | | 10/2009 | McBride | |
| 2012/0031159 | A1 | * | 2/2012 | Seidel | B21B 27/10 72/6.2 |
| 2015/0020564 | A1 | * | 1/2015 | Kipping | B21B 27/10 72/201 |
| 2019/0217355 | A1 | | 7/2019 | Freliez et al. | |

FOREIGN PATENT DOCUMENTS

| | | | | |
|---|---|---|---|---|
| DE | 102016204501 | A1 | | 7/2017 |
| EP | 0313516 | A1 | | 4/1989 |
| EP | 1142652 | A2 | | 10/2001 |
| FR | 3056419 | A1 | | 3/2018 |
| JP | S5410931 | U | | 1/1979 |
| JP | S63224806 | A | | 9/1988 |
| JP | H0232310 | A | | 2/1990 |
| JP | H07239040 | A | | 9/1995 |
| JP | H07265916 | A | | 10/1995 |
| JP | 105827 | A | | 1/1998 |
| JP | H105827 | | * | 1/1998 |
| JP | 2008185203 | A | | 8/2008 |
| KR | 100254076 | B1 | | 4/2000 |
| RU | 2193936 | C1 | | 12/2002 |
| SU | 749472 | | | 7/1980 |
| WO | 2005/115651 | A1 | | 12/2005 |
| WO | 2012/110241 | A1 | | 8/2012 |
| WO | 2015/086119 | A1 | | 6/2015 |
| WO | 2015169475 | A1 | | 11/2015 |
| WO | 2016/083128 | A1 | | 6/2016 |

OTHER PUBLICATIONS

AU2019287520, "First Examination Report", dated Feb. 19, 2020, 2 pages.
RU2020102144, "Office Action", dated Feb. 27, 2020, 12 pages.
International Search Report and Written Opinion issued in Application No. PCT/US2019/037041 dated Sep. 23, 2019, 8 pages.
International Search Report and Written Opinion issued in Application No. PCT/US2019/037036 dated Nov. 25, 2019, 11 pages.
International Search Report and Written Opinion issued in Application No. PCT/US2019/037039 dated Sep. 18, 2019, 13 pages.
Canadian Patent Application No. 3,070,014 , "Office Action", dated Apr. 2, 2020, 4 pages.
Korean Patent Application No. 10-2020-7002701 , "Office Action", dated Mar. 19, 2020, 18 pages.
"Oil Seal Material Chart", Barnwell The Seal of a Approval, 2018, Available Online at: https://www.barnell.co.uk/oil-seal-materials/, 5 pages.
Application No. JP2020-506152 , Office Action, dated Aug. 25, 2020, 4 pages.

* cited by examiner

SYSTEMS AND METHODS FOR COOLING A ROLL IN METAL PROCESSING

CROSS-REFERENCE TO RELATED APPLICATION

The present application claims priority to and filing benefit of U.S. Provisional Patent Application No. 62/684,443, filed on Jun. 13, 2018, which is incorporated herein by reference in its entirety.

TECHNICAL FIELD

The present disclosure relates to metallurgy generally and more specifically to metal manufacturing.

BACKGROUND

Unless otherwise indicated herein, the materials described in this section are not prior art to the claims in this application and are not admitted to be prior art by inclusion in this section.

Existing roll cooling systems and methods can use a coolant application header to supply coolant to a work roll and further employ a separate wiper to contain the coolant applied to the work roll and/or a rolled metal product (e.g., a metal article) during and/or after processing steps performed at elevated temperatures (e.g., hot rolling, cold rolling, and/or warm rolling). In some aspects, existing roll cooling systems and methods can result in cross-contamination of various processes (e.g., a coolant can contaminate a lubricant, a cleaner can contaminate a pretreatment, etc.). In further aspects, the wiper is in constant contact with the roll surface, risking collection of debris which can damage the work roll and/or the metal article surface. Additionally, a vacuum system can be employed to remove coolant from the work roll and/or the metal article after cooling. Vacuuming uncontained coolant can be ineffective at removing coolant from the work roll and/or metal article, particularly when processing is stopped and/or reversed.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Described herein is a system for containing a viscous material applied to a surface, the system including a housing, a viscous material delivery device, a plurality of seals movable between a first position and a second position, wherein a contacting edge of each seal of the plurality of seals contacts the surface in the first position and is separated from the surface by a gap in the second position, wherein the surface carries the viscous material toward at least one seal of the plurality of seals, and a plurality of gas delivery devices, wherein each of the plurality of gas delivery devices is configured to supply gas toward the contacting edge of at least one seal of the plurality of seals to move the at least one seal between the first and second positions wherein the contacting edge of at least the one seal is separated from the surface by the gap, and wherein when each of the plurality of seals is in the second position, the gas supplied by the plurality of gas delivery devices prevents the viscous material from exiting the housing by acting as a contactless seal. In some cases, the viscous material can be a liquid, a gel, a sol-gel, a glass, or any combination thereof (e.g., a cleaner, a lubricant, a treatment, a pretreatment, an aesthetic coating, a coolant, or any combination thereof). In some aspects, the surface is a moving surface (e.g., a roll or a roll processed engineering material). In some aspects, the moving surface carries the viscous material toward at least one seal of the plurality of seals. In some non-limiting examples, the roll can be a work roll, a backup roll, or an intermediate roll, and the roll processed engineering material can be a metal, a polymer, a composite, or any combination thereof.

In some examples, the housing includes a top, a bottom, a first side, a second side opposite the first side, a back, and a face opposite the back, wherein the face is directed toward at least the roll, and the top, the bottom, the first side, the second side, and the back can be solid panels. In some cases, the back can further include a vent, and the face can be open. In some non-limiting examples, when the surface is a roll processed engineering material, the face is shaped to at least partially conform to a substantially planar surface. Thus, a shape of the face is determined by a face edge of the top, a face edge of the bottom, a face edge the first side, and a face edge of the second side (e.g., the face edge of the top and the face edge of the bottom can be straight and parallel and the face edge of the first side and the face edge of the second side are straight. In some further non-limiting examples, when the surface is a roll, the face edge of the first side and the face edge of the second side can be curved to match a curvature of the roll. In some cases, the face can be shaped to at least partially conform about a plurality of circular rolls (e.g., the face edge of the top and the face edge of the bottom can be straight and parallel, and the face edge of the first side and the face edge of the second side can be shaped to match a curvature of at least a first roll, a curvature of a second roll, and a nip area). In some aspects, an intersection of the bottom and the back can form a drain.

In some non-limiting examples, the viscous material delivery device can be disposed within the housing (e.g., inserted through the vent, or inserted through a port disposed in the first side, the second side, the top, or the bottom of the housing). The viscous material delivery device can further include a viscous material entry port disposed in the first side, the second side, the top, or the bottom, and a viscous material exit port disposed opposite the viscous material entry port. In some cases, the viscous material delivery device further includes a plurality of nozzles aimed toward the face of the housing. Additionally, the system can include a debris removal brush that can be a static brush or a movable brush (e.g., a rotary brush, an oscillating brush, or a vibrating brush).

In some non-limiting examples, the plurality of seals includes a top seal attached to the face edge of the top, a bottom seal attached to the face edge of the bottom, a first side seal attached to the face edge of the first side, and a second side seal attached to the face edge of the second side. In some examples, each seal of the plurality of seals is maintained in the first position by positioning the system adjacent to at least the surface. In some aspects, when each seal of the plurality of seals is in the first position, each seal is between an angle that is substantially parallel to at least the surface and substantially perpendicular to at least the surface. In some examples, each gas delivery device of the plurality of gas delivery devices is configured to supply the gas at a velocity sufficient to move each seal of the plurality of seals into the second position. In some aspects, each gas delivery device of the plurality of gas delivery devices is configured to supply the gas at a velocity sufficient to prevent a viscous material from passing through the gap when each seal of the plurality of seals is in the second position. In some cases, when in an absence of supplied gas, each seal of the plurality of seals is in the first position, the viscous material is capable of flowing onto at least one of the seals of the plurality of seals, into the housing, through the housing, and into the drain. In some further examples, a collection device can be disposed at an exit of the drain (e.g., a channel, a vacuum bar, or a sink).

In some non-limiting examples, the seal can be a flexible seal (e.g., a polymer seal, a polysilicon seal, or a fabric seal). In some cases, the seal can be rigid. In some further examples, each gas delivery device of the plurality of gas delivery devices is a forced gas delivery device (e.g., an air knife).

Also described herein is a method of containing a viscous material applied to at least one surface employing the system described above, including moving the housing adjacent to at least the surface, delivering the viscous material to at least the surface, and delivering the gas from the plurality of gas delivery devices toward the contacting edge of each seal of the plurality of seals to move each seal of the plurality of seals into the second position where the contacting edge of each seal of the plurality of seals is separated from at least the surface by the gap, wherein a velocity of the gas is sufficient to prevent the viscous material on at least the surface from passing through the gap. In some aspects, moving the housing adjacent to at least the surface comprises moving each seal of the plurality of seals into the first position to contact at least the surface, and wherein each seal of the plurality of seals is a flexible seal or a rigid seal. In some non-limiting examples, moving the plurality of seals into the first position to contact at least the surface further includes biasing each seal of the plurality of seals toward at least the surface.

In some cases, delivering the gas by the plurality of gas delivery devices is performed by a plurality of forced gas delivery systems (e.g., air knives). In some aspects, delivering the gas urges each seal of the plurality of seals to move into the second position. In some further examples, the methods described herein can include removing the viscous material from at least the surface. For example, delivering the gas to prevent the viscous material from passing through each gap can allow the viscous material to flow onto at least one of the seals of the plurality of seals and into the housing. Additionally, deactivating each gas delivery device of the plurality of gas delivery devices to move each seal of the plurality of seals into the first position can allow the viscous material to flow over, for example, the bottom edge seal, and into the housing. The viscous material can then flow through the housing and into the drain, wherein the drain further comprises a collection device that can be a channel, a vacuum bar, or a sink.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
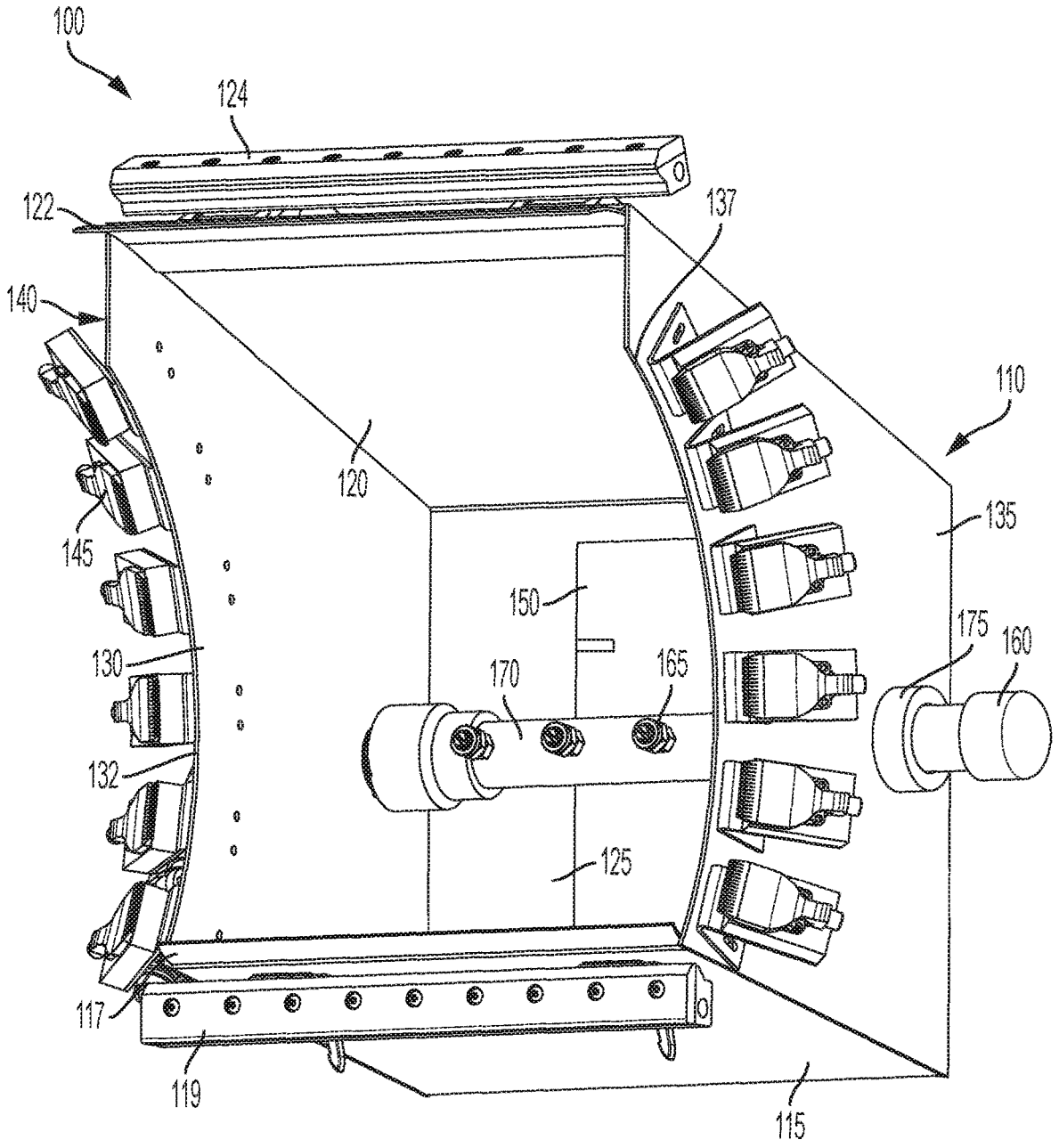
FIG. 1 is a perspective view of a coolant containment system according to certain aspects of the present disclosure.

Certain aspects and features of the present disclosure relate to application, containment, and/or removal of a viscous material. In certain aspects, the viscous material is applied to, contained on, and/or removed from a surface of an engineering material (for example, a metal article such as a metal strip being roll processed), a work roll processing the engineering material, or any suitable moving article requiring the application, containment, and/or removal of a viscous material as part of processing the moving article. Further aspects and features of the present disclosure relate to rolling mills for rolling a metal article in a hot rolling mode, a cold rolling mode, a warm rolling mode, or any combination thereof. Further aspects and features of the present disclosure relate to systems and methods of cooling rolls involved in the hot rolling, cold rolling, or warm rolling and/or the metal article being rolled. Still further aspects of the present disclosure relate to systems and methods for containing a coolant applied to the rolls and/or the metal article without damaging a surface of the metal article.

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

As used herein, the meaning of "a," "an," or "the" includes singular and plural references unless the context clearly dictates otherwise.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

In some non-limiting examples, a rolling mill can include at least one work stand, and in some examples, the rolling mill can include multiple stands. For example, the rolling mill may include two stands, three stands, four stands, five stands, six stands, or any other number of stands as needed or desired. Each stand can include a pair of work rolls that are vertically aligned. In some cases, each stand includes a pair of backup rolls that support the pair of work rolls. In some examples, each stand also includes a pair of intermediate rolls. The rolls can be stainless steel, steel, or made of any suitable material. During rolling of the metal article, the metal article is passed through a roll gap defined between the work rolls. Rolling the metal article reduces the thickness of the metal article to a desired thickness and imparts particular properties on the metal article depending on the composition of the metal article. Depending on the desired properties or other considerations for the final metal product, the rolling mill may be run in a hot rolling mode, a cold rolling mode, a warm rolling mode, or any combination thereof.

In some examples, the metal article is aluminum, an aluminum alloy, magnesium, a magnesium-based material, titanium, a titanium-based material, copper, a copper-based material, steel, a steel-based material, bronze, a bronze-based material, brass, a brass-based material, a composite, a sheet used in composites, or any other suitable metal or combination of materials. The article may include monolithic materials, as well as non-monolithic materials such as roll-bonded materials, clad materials, composite materials (such as but not limited to carbon fiber-containing materials), or various other materials. In some examples, the metal article is a metal coil, a metal strip, a metal plate, a metal sheet, a metal billet, a metal ingot, or the like. In some cases, the systems and methods described herein can be used with a non-metal article.

Hot rolling generally occurs at temperatures above a recrystallization temperature of the metal. For example, in some cases where the metal article is aluminum or an aluminum alloy, hot rolling may occur at a temperature greater than about 250° C., such as from about 250° C. to about 550° C. In other examples, various other temperatures for hot rolling may be used.

In contrast to hot rolling, cold rolling generally occurs at temperatures below the recrystallization temperature of the metal. For example, in some cases wherein the metal article is aluminum or an aluminum alloy, cold rolling may occur at a temperature less than about 200° C., such as from about 20° C. to about 200° C. In other examples, various other temperatures for cold rolling may be used.

In some cases, a metal article may be rolled through a warm rolling process, which occurs at a temperature below the recrystallization temperature of the metal but above the cold rolling temperature. For example, in some cases where the metal article is aluminum or an aluminum alloy, warm rolling may occur at a temperature from about 200° C. to about 250° C. In other examples, various other temperatures for warm rolling may be used.

In some examples, the rolling mill has a roll cooling system that includes a coolant delivery device and a coolant containment system adjacent to the work roll and/or the backup roll. In some examples, the roll cooling system is configured to reduce a temperature of the work rolls and/or the backup rolls during processing. In various examples, the coolant delivery device is configured to apply a coolant on at least one surface of the work rolls and/or the backup rolls to control the temperature of the work rolls and/or the backup rolls. In some examples, the coolant containment system is configured to contain the coolant to a desired area on the work roll and/or the backup roll, and to remove the coolant or dry the work roll and/or the backup roll. In some cases, the coolant containment system helps prevent or minimize coolant from contacting the metal article. In various examples, depending on the configuration of the rolling mill, any number of coolant delivery devices and coolant containment systems may be utilized. The roll cooling system may be provided at various locations within the rolling mill such as at an upper work roll, at a lower work roll, at an upper backup roll, at a lower backup roll, combinations thereof, or any suitable location where cooling is desired.

Although this description is provided in the context of liquid coolants, the systems and methods described herein can be used for any viscous materials, including coolants, cleaners, treatments, pretreatments, aesthetic coatings, lubricants (e.g., gels, sol-gels, and certain glasses), etc., or any combination thereof.

In some non-limiting examples, the roll cooling system can include a housing, a coolant delivery system, a coolant, and a coolant containment system. The disclosed cooling system can be a compact cooling system when compared to conventional roll cooling systems, thus enabling implementation at any desired point in a rolling mill, including retrofitting existing rolling mills with the disclosed cooling system.

In some examples, the housing of the disclosed cooling system can further include a plurality of seals and a plurality of gas delivery devices. The plurality of seals can be flexible seals or rigid seals. If flexible, the plurality of seals can be a plurality of polymer seals. Polymers for use in the polymer seal include, for example, synthetic rubber (styrene-butadiene), natural rubber, elastomers, cellulose, or the like, or any combinations thereof. In some examples, the seal can be a polysilicon seal, a brush, a fabric seal, or a seal made of any suitable material that will not damage the work roll when contacting the work roll or, for example, when employed to cool a metal article, will not damage the metal article when contacting the metal article. In some cases, the seals can be rigid seals made of any suitable material that will not damage the work roll and/or the backup roll when contacting the work roll and/or the backup roll. In some non-limiting examples, the plurality of gas delivery systems is a plurality of forced gas delivery systems. In some cases, the plurality of forced gas delivery systems is a plurality of air knives.

In some aspects, the roll cooling system can be positioned adjacent to a rotating roll. In some cases, the rotating roll (e.g., the work roll and/or the backup roll) rotates in a direction such that it carries the coolant toward at least one seal of the plurality of seals.

In some examples, the rolling mill additionally or alternatively includes a metal article cooling system that is configured to apply a coolant to the outer surface of the metal article to control a temperature of the metal article. In some non-limiting examples, the coolant is water, oil, gel, or any suitable heat transfer medium. In some cases, the coolant is an organic heat transfer medium, a silicone fluid heat transfer medium, or a glycol-based heat transfer medium (e.g., ethylene glycol, propylene glycol, any other polyalkylene glycol, or any combination thereof), or the like.

In some cases, the rolling mill includes one or more systems that can simultaneously apply various viscous materials to, for example, a metal article and a work roll. In some non-limiting examples, a roll cooling system and a metal article lubricating system can be simultaneously employed. In such scenarios, a liquid coolant applied by the roll cooling system and a liquid lubricant applied by the metal article lubricating system should not cross-contaminate, further requiring sequestration of the liquid coolant from the liquid lubricant. In some non-limiting examples, the roll cooling system can contain the liquid coolant to the roll and the metal article lubricating system can contain the liquid lubricant to the metal article, thus sequestering the liquid coolant from the liquid lubricant.

In some examples, including a plurality of seals and a plurality of gas delivery devices can define a perimeter wherein a viscous material, such as a coolant, can be contained. Briefly, to be explained in detail below, the plurality of seals and the plurality of gas delivery devices can create a contactless seal where gas propagating between a seal and, for example, a surface of a work roll and/or a backup roll can keep viscous materials and/or debris in a desired position (i.e., the viscous materials and/or debris cannot pass the seal). In some non-limiting examples, creating such a contactless seal can provide viscous material and/or debris containment without a threat of debris becoming trapped between the seal and the work roll and/or the backup roll and damaging the work roll and/or the backup roll, and/or the seal. In some aspects, the plurality of seals and the plurality of gas delivery devices can be configured to define a containment area. The containment area can be further configured to divert any viscous materials and/or debris contained therein away from the work roll and/or the backup roll and into the housing. In some cases, the housing can be configured to discharge the viscous materials and/or debris from the roll cooling system. In some non-limiting examples, the viscous materials (e.g., a coolant) can be cleaned, recycled, and/or reused.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a perspective view of a viscous material containment system 100 as described herein. The viscous material containment system 100 can be employed to cool one or more rolls and can be configured to contain any liquid coolant applied to the one or more rolls, and/or can be configured to contain contaminants and debris accumulating on the roll during cooling (e.g., debris agitated about the roll during cooling with a gaseous coolant, and/or debris lifted from the roll during cooling with a liquid coolant). For example, the viscous material containment system 100 can be configured to prevent or minimize coolant applied to one or more rolls from contacting a metal article passing through a work stand. The viscous material containment system 100 includes a housing 110 that can include a bottom 115, a top 120, a back 125, a first side 130, and a second side 135. In some non-limiting examples, the first side 130 and the second side 135 can have a shape such that the housing 110 can conform to a shape of a roll (e.g., a work roll) being subjected to cooling employing the viscous material containment system 100. In some further non-limiting examples, the first side 130 and the second side 135 can have a shape such that the housing 110 can conform to a shape of a pair of rolls (e.g., a work roll and a backup roll). In still further non-limiting examples, the first side 130 and the second side 135 can have a shape such that the housing 110 can conform to a shape of a substantially planar material article (e.g., a metal article, a polymer film, or any suitable article requiring application, containment, and removal of a viscous material), and the viscous material containment system 100 can be used to cool the material article instead of or in addition to the one or more rolls. In some aspects, a face 140 of the housing 110 can be an opening defined by the bottom 115, the top 120, the first side 130 and the second side 135. In some examples, at least part of the face 140 can have a convex shape as defined by the bottom 115, the top 120, the first side 130, and/or the second side 135 such that the face 140 of the housing 110 can conform to a roll and/or a pair of rolls.

As shown in FIG. 1, the housing 110 of the viscous material containment system 100 can further include a plurality of flexible seals disposed about the face 140 of the housing 110, and the housing 110 can further include a plurality of gas delivery devices disposed adjacent to the plurality of flexible seals. For example, the bottom 115 can include a bottom edge seal 117, and the top 120 can include a top edge seal 122. The bottom 115 and the top 120 can further include a bottom edge gas delivery device 119 and a top edge gas delivery device 124, respectively. The bottom edge seal 117 and the top edge seal 122 can be flexible or rigid and formed of any suitable material. For example, the bottom edge seal 117 and the top edge seal 122 can be a polymer seal. Exemplary polymers for use in the polymer seal include, for example, synthetic rubber (styrene-butadiene), natural rubber, elastomers, cellulose, or the like, or any combinations thereof. In some examples, the seal can be a polysilicon seal, a brush, a fabric seal, or a seal made of any suitable material that will not damage the roll or the pair of rolls.

The housing 110 also can have a first side edge seal 132 attached to a face edge of the first side 130 and a second side edge seal 137 attached to a face edge of the second side 135. The first side 130 and the second side 135 can further include a plurality of gas delivery devices 145 disposed adjacent to the first side edge seal 132 and the second side edge seal 137. In some non-limiting examples, the first side edge seal 132 and the second side edge seal 137 are flexible seals that are able to conform to the shape of the first side 130 and the shape of the second side 135, such that the first side edge seal 132 and the second side edge seal 137 can further conform to the roll.

In some non-limiting examples, at least the first side edge seal 132 and the second side edge seal 137 can be a brush. In some cases, one or more of the bottom edge seal 117, the top edge seal 122, the first side edge seal 132, and the second side edge seal 137 can be a brush. Thus, when the viscous material containment system 100 is in the first position, the brushes creating the bottom edge seal 117, the top edge seal 122, the first side edge seal 132, and the second side edge seal 137 can contact the work roll via a plurality of bristles. In some examples, the plurality of bristles can be any suitable material that will not damage the work roll and/or the backup roll. For example, the bristles can be polymer bristles. Exemplary polymers for use in the polymer bristles include, for example, synthetic rubber (styrene-butadiene), natural rubber, elastomers, cellulose, or the like, or any combinations thereof. In some examples, the bristles can be polysilicon bristles, fabric bristles, or bristles made of any suitable material that will not damage a roll and/or material article when contacting the roll and/or the material article.

The back 125 can include a vent 150 that can allow for cleaning of the housing 110, insertion of coolant applicators, insertion of roll cleaning brushes, access for maintenance, or the like. The viscous material containment system 100 can further include a viscous material delivery device 160. The viscous material delivery device 160 can include at least one nozzle 165, and can still further include a plurality of the nozzle 165. The viscous material delivery device 160 can be disposed within the housing 110 in any suitable way, including passing the viscous material delivery device 160 through an entrance port 170 disposed in the first side 130, and optionally through an exit port 175 disposed in the second side 135. Optionally, the viscous material delivery device 160 can be inserted into the housing 110 through the vent 150 disposed in the back 125.

Figure 2:
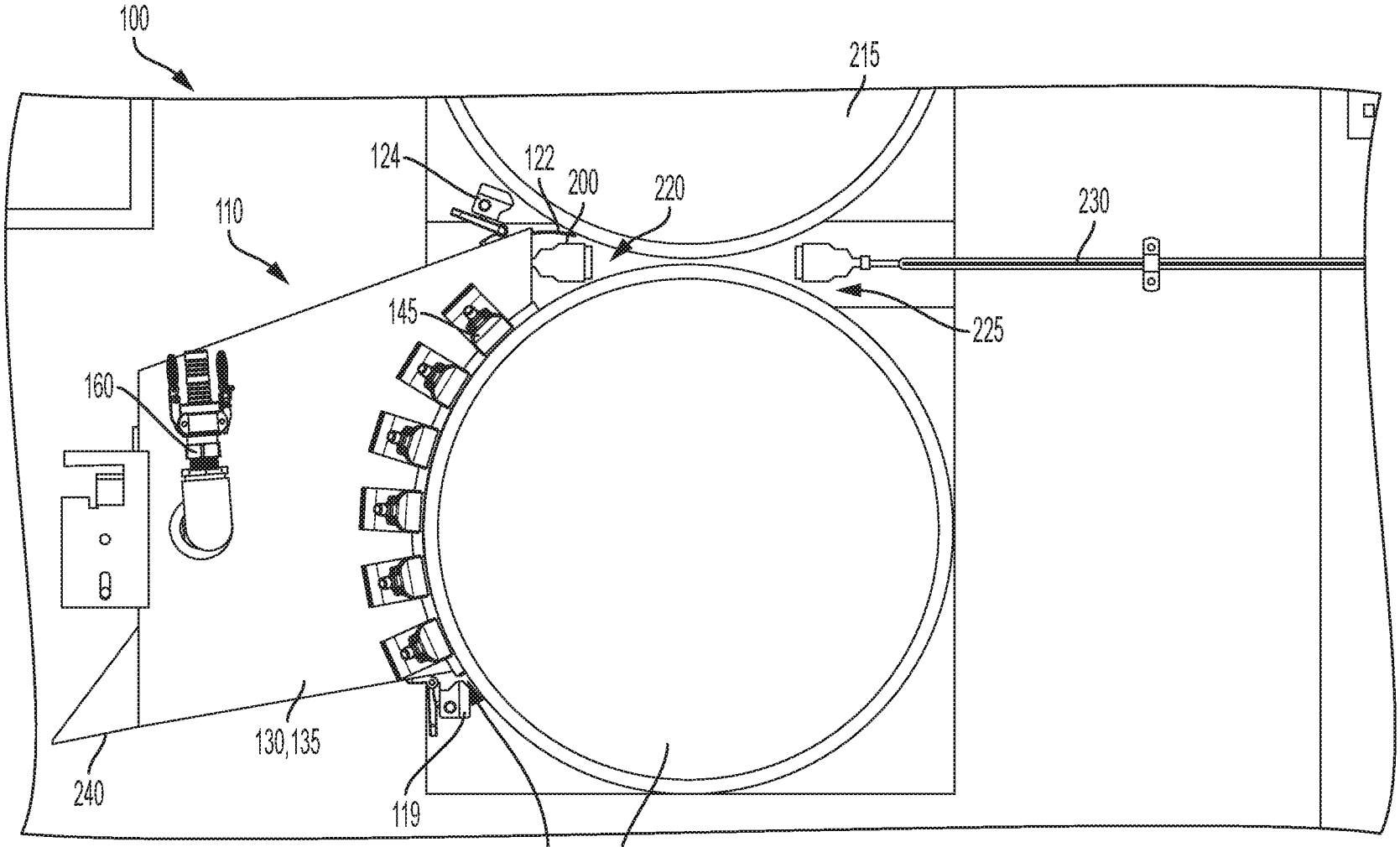
FIG. 2 is a perspective view of a coolant containment system disposed adjacent to a work roll according to certain aspects of the present disclosure.

The viscous material containment system 100 can be positioned adjacent to a roll (e.g., a work roll, a backup roll, and/or an intermediate roll), a pair of rolls (e.g., a work roll and a backup roll) as shown in FIG. 2, or adjacent to a metal article or the like. The viscous material containment system 100 can be positioned adjacent to a work roll 210 such that the bottom edge seal 117, the top edge seal 122, the first side edge seal 132 (see FIG. 1) and the second side edge seal 137 (see FIG. 1) are in a first position. When in the first position, the bottom edge seal 117, the first side edge seal 132 and the second side edge seal 137 each contact the work roll 210, and the top edge seal 122 contacts a backup roll 215. In some non-limiting examples, the bottom edge seal 117, the top edge seal 122, the first side edge seal 132 and the second side edge seal 137 define the containment area as described above.

In some non-limiting examples, the bottom edge seal 117, the top edge seal 122, the first side edge seal 132, and the second side edge seal 137 have a sufficient elasticity such that when the viscous material containment system 100 is positioned adjacent to a roll, a pair of rolls, or a metal article or the like, the elasticity of the bottom edge seal 117, the top edge seal 122, the first side edge seal 132, and the second side edge seal 137 maintains the bottom edge seal 117, the top edge seal 122, the first side edge seal 132, and the second side edge seal 137 in contact with the roll, pair of rolls, or the metal article or the like (i.e., a surface). For example, the viscous material containment system 100 can be moved into a position such that the bottom edge seal 117, the top edge seal 122, the first side edge seal 132, and the second side edge seal 137 contact the surface. The viscous material containment system 100 can subsequently be further driven toward the surface causing the bottom edge seal 117, the top edge seal 122, the first side edge seal 132, and the second side edge seal 137 to bend while in contact with the surface. The elasticity of the bottom edge seal 117, the top edge seal 122, the first side edge seal 132, and the second side edge seal 137 then biases the bottom edge seal 117, the top edge seal 122, the first side edge seal 132, and the second side edge seal 137 further in contact with the surface in an effort to return the bottom edge seal 117, the top edge seal 122, the first side edge seal 132, and the second side edge seal 137 to an unbent configuration.

Additionally or alternatively, the bottom edge seal 117, the first side edge seal 132 and the second side edge seal 137 can be biased into contact with the work roll 210 by a spring-loaded device, an actuator, a tensioner, or any suitable moveable biasing mechanism. The top edge seal 122 can be biased into contact with the backup roll 215 by a spring-loaded device, an actuator, a tensioner, or any suitable moveable biasing mechanism. One or more biasing mechanisms can be configured to apply pressure to the bottom edge seal 117, the first side edge seal 132 and the second side edge seal 137 to urge the bottom edge seal 117, the first side edge seal 132 and the second side edge seal 137 into contact with the work roll 210. One or more biasing mechanisms can be configured to apply pressure to the top edge seal 122 into contact with the backup roll 215. In some cases, the top edge seal 122 contacts the work roll 210 instead of the backup roll 215. Applying pressure from the biasing mechanism can be manually controlled (e.g., using thumb screws), computer controlled (e.g., using servo driven actuators), or uncontrolled (e.g., the pressure can be applied but not adjusted). In some non-limiting examples, the biasing mechanism can maintain the bottom edge seal 117, the first side edge seal 132 and the second side edge seal 137 in contact with the work roll 210 as the work roll 210 can shrink in diameter over time. In some non-limiting examples, the biasing mechanism can maintain the top edge seal 122 in contact with the backup roll 215 as the backup roll 215 can shrink in diameter over time.

The bottom edge seal 117, the first side edge seal 132 and the second side edge seal 137 can be moved into a second position where the bottom edge seal 117, the first side edge seal 132 and the second side edge seal 137 do not contact the work roll 210. Likewise, the top edge seal 122 can be moved into a second position where the top edge seal 122 does not contact the backup roll 215. In particular, a contacting longitudinal edge of the bottom edge seal 117, the first side edge seal 132 and the second side edge seal 137 are separated from the work roll 210 by a gap, and the top edge seal 122 is separated from the backup roll 215 by a gap. The bottom edge gas delivery device 119, the top edge gas delivery device 124, and the plurality of gas delivery device 145, which may be an air knife or other forced gas delivery device, can be configured to deliver a stream of gas toward the contacting longitudinal edge of the bottom edge seal 117, the top edge seal 122, the first side edge seal 132 and the second side edge seal 137. Delivering the stream of gas from the bottom edge gas delivery device 119, the top edge gas delivery device 124, and the plurality of gas delivery device 145 can move the bottom edge seal 117, the top edge seal 122, the first side edge seal 132 and the second side edge seal 137 from the first position into the second position creating the gap between the work roll 210 and the bottom edge seal 117, the first side edge seal 132 and the second side edge seal 137, and the gap between the top edge seal 122 and the backup roll 215. The gap can have any suitable dimensions, such as a width of from about 0.1 millimeters (mm) to about 3.0 mm, or greater. For example, the gap can be about 0.1 mm, about 0.15 mm, about 0.2 mm, about 0.25 mm, about 0.3 mm, about 0.35 mm, about 0.4 mm, about 0.45 mm, about 0.5 mm, about 0.55 mm, about 0.6 mm, about 0.65 mm, about 0.7 mm, about 0.75 mm, about 0.8 mm, about 0.85 mm, about 0.9 mm, about 0.95 mm, about 1.0 mm, about 1.1 mm, about 1.2, mm, about 1.3 mm, about 1.4 mm, about 1.5 mm, about 1.6 mm, about 1.7 mm, about 1.8 mm, about 1.9 mm, about 2.0 mm, about 2.1 mm, about 2.2, mm, about 2.3 mm, about 2.4 mm, about 2.5 mm, about 2.6 mm, about 2.7 mm, about 2.8 mm, about 2.9 mm, or about 3.0 mm, or anywhere in between.

The gas streams from the bottom edge gas delivery device 119, the top edge gas delivery device 124, and the plurality of gas delivery device 145 are aimed in a direction such that the gas is concentrated at a location where the bottom edge seal 117, the first side edge seal 132 and the second side edge seal 137 contacts the work roll 210 with the contacting longitudinal edge, and the top edge seal 122 contacts the backup roll 215 with the contacting longitudinal edge. Force applied by delivering the gas streams can move the bottom edge seal 117, the top edge seal 122, the first side edge seal 132 and the second side edge seal 137 into the second position, thereby creating the gap between the work roll 210 and the bottom edge seal 117, the first side edge seal 132 and the second side edge seal 137, and the gap between the top edge seal 122 and the backup roll 215.

The gas streams can propagate through the gap between the bottom edge seal 117, the first side edge seal 132 and the second side edge seal 137 and the work roll 210, and the gap between the top edge seal 122 and the backup roll 215, at any suitable velocity. The velocity can be determined by a flow rate of the gas streams and a size of the gap between the bottom edge seal 117, the first side edge seal 132 and the second side edge seal 137 and the work roll 210, and the size of the gap between the top edge seal 122 and the backup roll 215. The size of the gap between the bottom edge seal 117, the first side edge seal 132 and the second side edge seal 137 and the work roll 210, and the size of the gap between the top edge seal 122 and the backup roll 215 can be determined by pressure applied by the biasing mechanism. The pressure applied by the biasing mechanism can be any pressure such that the bottom edge seal 117, the first side edge seal 132 and the second side edge seal 137 do not damage the work roll 210 when the bottom edge seal 117, the first side edge seal 132 and the second side edge seal 137 are in the first position, or when the gas streams are deactivated and the bottom edge seal 117, the first side edge seal 132 and the second side edge seal 137 move from the second position to the first position. Likewise, the pressure applied by the biasing mechanism can be any pressure such that the top edge seal 122 does not damage the backup roll 215 when the top edge seal 122 is in the first position, or when the gas streams are deactivated and the top edge seal 122 moves from the second position to the first position. The velocity of the gas streams can be sufficient to maintain any viscous material, such as liquid coolant, at a position on the surface of the work roll 210 and the backup roll 215 such that the liquid coolant cannot enter the gaps created on the work roll 210 or the gap created on the backup roll 215. In some further examples, the viscous material, such as liquid coolant, cannot move through the gap between the bottom edge seal 117, the first side edge seal 132 and the second side edge seal 137 and the work roll 210, and/or the gap between the top edge seal 122 and the backup roll 215 when the seals are in the second position (i.e., so the viscous material cannot move through the gaps onto the metal article by passing over the work roll 210 and/or the backup roll 215).

Optionally, an auxiliary gas delivery device 200 can be positioned adjacent to an external surface of the first side 130 and/or adjacent to an external surface of the second side 135 of the housing 110 (see FIG. 2). The auxiliary gas delivery device 200 can be positioned such that gas is delivered to a nip area 220 between the viscous material containment system 100, the work roll 210 and the backup roll 215. The auxiliary gas delivery device 200 can be configured to deliver gas from an outer edge of the work roll 210 and the backup roll 215 toward a longitudinal center of the work roll 210 and the backup roll 215, such that any liquid in the nip area 220 can be contained within the nip area 220 and ultimately contained by the viscous material containment system 100. Optionally, an opposing gas delivery system 230 can be positioned in a nip area 225 on a side of the work roll 210 and the backup roll 215 opposite the nip area 220 between the viscous material containment system 100, the work roll 210 and the backup roll 215. The opposing gas delivery system 230 can further be positioned at about a longitudinal center of the work roll 210 and the backup roll 215. The opposing gas delivery system 230 can be configured to deliver gas in a direction from the longitudinal center of the work roll 210 and the backup roll 215 toward the outer edges of the work roll 210 and the backup roll 215 (e.g., gas is delivered such that any viscous material attempting to pass between the work roll 210 and the backup roll 215 is forced back into the nip area 220 between the viscous material containment system 100, the work roll 210 and the backup roll 215, and contained by the viscous material containment system 100 and the auxiliary gas delivery device 200 positioned adjacent to an external surface of the first side 130 and/or adjacent to an external surface of the second side 135 of the housing 110). Delivering gas from the opposing gas delivery system 230 can prevent any viscous materials and/or debris from passing between the work roll 210 and the backup roll 215 and being subsequently deposited onto the metal article being rolled.

Optionally, the viscous material containment system 100 described herein can further include a debris removal brush to remove contaminants and debris that can adhere to a roll (e.g., a work roll, a backup roll, and/or an intermediate roll). The debris removal brush can be positioned within the housing 110 adjacent to the viscous material delivery device 160 such that the brush can contact the work roll 210 and/or the backup roll 215 when the viscous material containment system 100 is contacting the work roll 210 and/or the backup roll 215. The debris removal brush can be a static brush or a movable brush (e.g., a rotary brush, an oscillating brush, or a vibrating brush).

A static debris removal brush can be positioned within the housing 110 such that when the viscous material containment system 100 is in the first position, the static debris removal brush contacts the work roll 210 via a plurality of bristles. Thus, when the work roll 210 is rotating, the static debris removal brush can remove any debris passing through the plurality of bristles. In other examples, a movable debris removal brush can be positioned within the housing 110 such that when the viscous material containment system 100 is in the first position, the movable debris removal brush contacts the work roll 210 via a plurality of bristles. Additionally, for example, when employing a rotary brush, a drive mechanism can further be inserted into the housing 110 to engage the rotary brush. In some examples, the plurality of bristles that are sufficient to remove debris adhering to the roll can be any suitable material that will not damage the work roll 210 and/or the backup roll 215. For example, the bristles can be polymer bristles. Exemplary polymers for use in the polymer bristles include, for example, synthetic rubber (styrene-butadiene), natural rubber, elastomers, cellulose, or the like, or any combinations thereof. In some examples, the bristles can be polysilicon bristles, fabric bristles, or bristles made of any suitable material that will not damage a roll and/or material article when contacting the roll and/or the material article. In some non-limiting examples, the debris removal brush can remove contaminants and/or debris from the work roll 210 and force the contaminants and/or debris into the viscous material containment system 100. The contaminants and/or debris can then be subsequently removed from the viscous material containment system 100 by flowing through a drain 240 and/or removal through the vent 150.

In some non-limiting examples, the housing 110 can be configured to discharge any collected viscous material and/or debris through the drain 240, as shown in FIG. 2. The drain 240 can discharge any collected viscous material and/or debris into a vacuum system, a collection channel, a sink, or any suitable collection device. In some cases, the collected viscous material and/or debris and can be filtered, recycled and/or recirculated through the system.

In some non-limiting examples, when the plurality of gas delivery devices are deactivated, the plurality of seals can return to the first position, where the plurality of seals contacts the roll via the contacting longitudinal edge of each seal of the plurality of seals. Contacting the plurality of seals to the roll can help provide removal of any viscous material on the roll. For example, in some cases, the viscous material (e.g., coolant) can be delivered to the roll and contained by the top edge seal 122, the first side edge seal 132 and the second side edge seal 137 of the housing 110. The viscous material can then flow down over the roll and can further flow down over the contacting longitudinal edge of the bottom edge seal 117. The bottom edge seal 117 can guide the coolant into the housing 110, and the housing 110 can guide the viscous material into the drain 240. In some aspects, the drain 240 can be connected to a collector tray, a vacuum retrieval system (e.g., a vacuum bar, a vacuum line), a sink, or any suitable viscous material collection device. The viscous material can then be recycled and/or recirculated if desired.

The viscous material containment system 100 can be a compact system when compared to existing cooling and coolant containment systems. Because of its reduced size, the viscous material containment system 100 can be retrofitted with rolling mills that would not otherwise have enough space to accommodate a traditional viscous material application and/or containment system. In some examples, the viscous material containment system 100 can be positioned adjacent to any roll or pair of rolls in a rolling mill. In some aspects, the viscous material containment system 100 can be positioned adjacent to any roll requiring containment of an applied viscous material. The viscous material containment system 100 can be placed adjacent to an upper work roll, a lower work roll, an upper backup roll, a lower backup roll, a first work roll in a vertical rolling mill, a second work roll in a vertical rolling mill, a first backup roll in a vertical rolling mill, a second backup roll in a vertical rolling mill, or any roll requiring cooling using a liquid coolant, or any suitable combination thereof. In some examples, the viscous material can be supplied by a general viscous material supply system, wherein a compact system as described herein is supplied with viscous materials via feed lines and does not require a storage tank, thus maintaining the compactness of the viscous material containment system 100. In some aspects, supplying viscous materials via feed lines allows the viscous material containment system 100 to be adapted for applications including roll lubricating, roll cleaning, roll processed engineering material cooling, roll processed engineering material lubricating, roll processed engineering material cleaning, roll processed engineering material pretreating, or any suitable process requiring application, containment, and removal of a viscous material.

Figure 3:
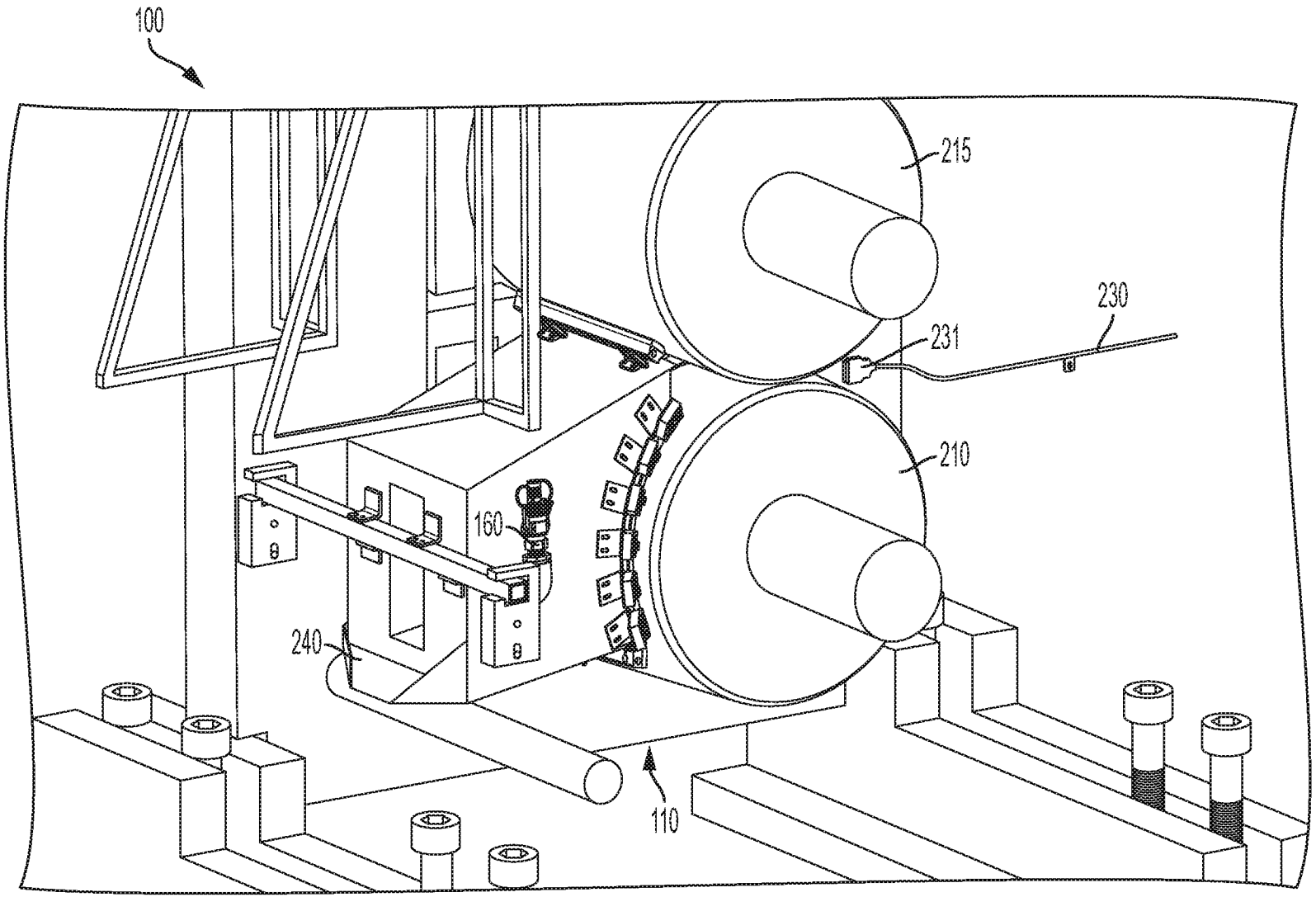
FIG. 3 is a perspective view of a coolant containment system disposed adjacent to a work roll according to certain aspects of the present disclosure.

FIG. 3 is a schematic showing a perspective view of the viscous material containment system 100 placed adjacent to a work roll 210 and a backup roll 215. Also depicted is the opposing gas delivery system 230 positioned such that a gas output manifold 231 is positioned at the longitudinal center of the work roll 210 and the backup roll 215. The viscous material containment system 100 can be positioned such that the bottom edge seal 117, the first side edge seal 132 and the second side edge seal 137 (see FIG. 1) contact the work roll 210 and the top edge seal 122 (see FIG. 1) contacts the backup roll 215. The viscous material delivery device 160 can be connected to an external viscous material supply system, thus allowing the viscous material containment system 100 to be placed adjacent to any roll and/or pair of rolls requiring application, containment, and removal of a viscous material (e.g., the viscous material containment system 100 does not contain viscous material storage vessels creating a larger system). Additionally, the drain 240 can be attached to any suitable external viscous material collection device (e.g., a channel, a vacuum bar, a vacuum line, or a sink). Employing an external viscous material collection device further provides a small footprint system, allowing the viscous material containment system 100 to be placed adjacent to any roll and/or pair of rolls requiring application, containment, and removal of a viscous material.

As used below, any reference to a series of examples is to be understood as a reference to each of those examples disjunctively (e.g., "Examples 1-4" is to be understood as "Examples 1, 2, 3, or 4").

Example 1 is a system for containing a viscous material applied to a surface, comprising: a housing; a viscous material delivery device; a plurality of seals movable between a first position and a second position, wherein a contacting edge of each seal of the plurality of seals contacts the surface in the first position and is separated from the surface by a gap in the second position, wherein the surface carries the viscous material toward at least one seal of the plurality of seals; and a plurality of gas delivery devices, wherein each of the plurality of gas delivery devices is configured to supply a gas toward the contacting edge of at least one seal of the plurality of seals to move the at least one seal from the first position to the second position wherein the contacting edge of the at least one seal is separated from the surface by the gap, and wherein, when each of the plurality of seals is in the second position, the gas supplied by the plurality of gas delivery devices prevents the viscous material from exiting the housing by acting as a contactless seal.

Example 2 is the system of any preceding or subsequent example, wherein the viscous material comprises a liquid, a gel, a sol-gel, a glass, or any combination thereof.

Example 3 is the system of any preceding or subsequent example, wherein the viscous material further comprises a cleaner, a lubricant, a treatment, a pretreatment, an aesthetic coating, a coolant, or any combination thereof.

Example 4 is the system of any preceding or subsequent example, wherein the surface comprises a moving surface.

Example 5 is the system of any preceding or subsequent example, wherein the moving surface comprises a roll or a roll processed engineering material.

Example 6 is the system of any preceding or subsequent example, wherein the roll comprises a work roll, a backup roll, or an intermediate roll.

Example 7 is the system of any preceding or subsequent example, wherein the roll processed engineering material comprises a metal strip, a polymer, a composite, or any combination thereof.

Example 8 is the system of any preceding or subsequent example, wherein the housing comprises a top, a bottom, a first side, a second side disposed opposite the first side, a back, and a face opposite the back, and wherein the face is directed toward at least the surface.

Example 9 is the system of any preceding or subsequent example, wherein the top, the bottom, the first side, the second side, and the back are solid panels.

Example 10 is the system of any preceding or subsequent example, wherein the back further comprises a vent.

Example 11 is the system of any preceding or subsequent example, wherein the face is open.

Example 12 is the system of any preceding or subsequent example, wherein when the surface is a roll processed engineering material, a shape of the face at least partially conforms to a substantially planar surface.

Example 13 is the system of any preceding or subsequent example, wherein a shape of the face is determined by a face edge of the top, a face edge of the bottom, a face edge the first side, and a face edge of the second side.

Example 14 is the system of any preceding or subsequent example, wherein the face edge of the top and the face edge of the bottom are straight.

Example 15 is the system of any preceding or subsequent example, wherein the face edge of the top and the face edge of the bottom are parallel.

Example 16 is the system of any preceding or subsequent example, wherein the face edge of the first side and the face edge of the second side are straight.

Example 17 is the system of any preceding or subsequent example, wherein the face edge of the first side and the face edge of the second side are parallel.

Example 18 is the system of any preceding or subsequent example, wherein when the surface is a roll, a face edge of the first side and a face edge of the second side are curved to match a curvature of the roll.

Example 19 is the system of any preceding or subsequent example, wherein the face is shaped to at least partially conform about a plurality of circular rolls.

Example 20 is the system of any preceding or subsequent example, wherein the face edge of the top and the face edge of the bottom are straight.

Example 21 is the system of any preceding or subsequent example, wherein the face edge of the top and the face edge of the bottom are parallel.

Example 22 is the system of any preceding or subsequent example, wherein the face edge of the first side and the face edge of the second side are shaped to match a curvature of at least a first roll, a curvature of a second roll, and a nip area.

Example 23 is the system of any preceding or subsequent example, wherein an intersection of the bottom and the back forms a drain.

Example 24 is the system of any preceding or subsequent example, wherein the viscous material delivery device is disposed within the housing.

Example 25 is the system of any preceding or subsequent example, wherein the viscous material delivery device is inserted through a vent.

Example 26 is the system of any preceding or subsequent example, wherein the viscous material delivery device is inserted through a port disposed in a first side, a second side, a top, or a bottom of the housing.

Example 27 is the system of any preceding or subsequent example, wherein the viscous material delivery device further comprises: a viscous material entry port disposed in the first side, the second side, the top, or the bottom; and a viscous material exit port disposed opposite the viscous material entry port.

Example 28 is the system of any preceding or subsequent example, wherein the viscous material delivery device further comprises a plurality of nozzles.

Example 29 is the system of any preceding or subsequent example, wherein each of the plurality of nozzles is aimed toward a face of the housing.

Example 30 is the system of any preceding or subsequent example, further comprising a debris removal brush.

Example 31 is the system of any preceding or subsequent example, wherein the debris removal brush is a static brush or a movable brush.

Example 32 is the system of any preceding or subsequent example, wherein the movable brush comprises a rotary brush, an oscillating brush, or a vibrating brush.

Example 33 is the system of any preceding or subsequent example, wherein the plurality of seals comprises a top seal attached to a face edge of a top, a bottom seal attached to a face edge of a bottom, a first side seal attached to a face edge of a first side, and a second side seal attached to a face edge of a second side.

Example 34 is the system of any preceding or subsequent example, wherein, when each seal of the plurality of seals is in the first position, each seal is between an angle that is substantially parallel to at least the surface and substantially perpendicular to at least the surface.

Example 35 is the system of any preceding or subsequent example, wherein each gas delivery device of the plurality of gas delivery devices is configured to supply the gas at a velocity sufficient to move each seal of the plurality of seals into the second position.

Example 36 is the system of any preceding or subsequent example, wherein each gas delivery device of the plurality of gas delivery devices is configured to supply the gas at a velocity sufficient to prevent a viscous material from passing through the gap when each seal of the plurality of seals is in the second position.

Example 37 is the system of any preceding or subsequent example, wherein, when in an absence of supplied gas, each seal of the plurality of seals is in the first position and the viscous material is capable of flowing onto at least one of the seals of the plurality of seals, into the housing, through the housing, and into a drain.

Example 38 is the system of any preceding or subsequent example, further comprising a collection device, wherein the collection device is disposed at an exit of the drain.

Example 39 is the system of any preceding or subsequent example, wherein the collection device is a channel, a vacuum bar, or a sink.

Example 40 is the system of any preceding or subsequent example, wherein each seal of the plurality of seals is a flexible seal.

Example 41 is the system of any preceding or subsequent example, wherein the flexible seal comprises a polymer seal, a polysilicon seal, or a fabric seal.

Example 42 is the system of any preceding or subsequent example, wherein each seal of the plurality of seals is rigid.

Example 43 is the system of any preceding or subsequent example, wherein each gas delivery device of the plurality of gas delivery devices is a forced gas delivery device.

Example 44 is the system of any preceding or subsequent example, wherein the forced gas delivery device is an air knife.

Example 45 is a method of containing a viscous material applied to a surface employing the system of any of any preceding or subsequent example, comprising: moving the housing adjacent to at least the surface; delivering the viscous material to at least the surface; and delivering the gas from the plurality of gas delivery devices toward the contacting edge of each seal of the plurality of seals to move each seal of the plurality of seals into the second position where the contacting edge of each seal of the plurality of seals is separated from at least the surface by the gap, wherein a velocity of the gas is sufficient to prevent the viscous material on at least the surface from passing through the gap.

Example 46 is the method of any preceding or subsequent example, wherein moving the housing adjacent to at least the surface comprises moving each seal of the plurality of seals into the first position to contact at least the surface, and wherein each seal of the plurality of seals is a flexible seal.

Example 47 is the method of any preceding or subsequent example, wherein moving the housing adjacent to at least the surface comprises moving each seal of the plurality of seals into the first position to contact at least the surface, and wherein each seal of the plurality of seals is a rigid seal.

Example 48 is the method of any preceding or subsequent example, wherein moving the plurality of seals into the first position to contact at least the surface further comprises biasing each seal of the plurality of seals toward at least the surface.

Example 49 is the method of any preceding or subsequent example, wherein delivering the gas by the plurality of gas delivery devices is performed by a plurality of forced gas delivery systems.

Example 50 is the method of any preceding or subsequent example, wherein delivering the gas by the plurality of forced gas delivery devices is performed by a plurality of air knives.

Example 51 is the method of any preceding or subsequent example, wherein delivering the gas urges each seal of the plurality of seals to move into the second position.

Example 52 is the method of any preceding or subsequent example, further comprising removing the viscous material from at least the surface, wherein the surface is a moving surface, and wherein the moving surface carries the viscous material toward at least one seal of the plurality of seals.

Example 53 is the method of any preceding or subsequent example, wherein delivering the gas to prevent the viscous material from passing through each gap allows the viscous material to flow onto at least one of each seal of the plurality of seals and into the housing.

Example 54 is the method of any preceding or subsequent example, further comprising deactivating each gas delivery device of the plurality of gas delivery devices to move each seal of the plurality of seals into the first position, wherein, in the first position, the viscous material is permitted to flow over a seal of the bottom of the housing into the housing.

Example 55 is the method of any preceding example, wherein the viscous material flows through the housing and into the drain, and wherein the drain further comprises a collection device that is a channel, a vacuum bar, or a sink.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A system for containing a viscous material applied to a surface, comprising:

a housing;

a viscous material delivery device;

a plurality of seals movable between a first position and a second position, wherein a contacting edge of each seal of the plurality of seals contacts the surface in the first position and is separated from the surface by a gap in the second position, and wherein the surface carries the viscous material toward at least one seal of the plurality of seals; and a plurality of gas delivery devices, wherein each of the plurality of gas delivery devices is configured to supply a gas toward the contacting edge of at least one seal of the plurality of seals to move the at least one seal from the first position to the second position wherein the contacting edge of the at least one seal is separated from the surface by the gap, wherein, when each of the plurality of seals is in the second position, the gas supplied by the plurality of gas delivery devices is configured to maintain the viscous material within the housing by acting as a contactless seal between the housing and the surface.

2. The system of claim 1, wherein the viscous material comprises a a cleaner, a lubricant, a treatment, a pretreatment, an aesthetic coating, a coolant, or any combination thereof.

3. The system of claim 1, wherein the surface comprises a roll or a roll processed engineering material.

4. The system of claim 1, wherein the housing comprises a top, a bottom, a first side, a second side disposed opposite the first side, a back, and a face opposite the back, wherein the face is configured to be directed toward at least the surface.

5. The system of claim 4, wherein when the surface is a roll processed engineering material, a shape of the face at least partially conforms to a planar surface, wherein the shape of the face is defined by a face edge of the top, a face edge of the bottom, a face edge of the first side, and a face edge of the second side, wherein the face edge of the top and the face edge of the bottom are straight, wherein the face edge of the top and the face edge of the bottom are parallel, wherein the face edge of the first side and the face edge of the second side are straight, and wherein the face edge of the first side and the face edge of the second side are parallel.

6. The system of claim 4, wherein when the surface is a roll, a face edge of the first side and a face edge of the second side are curved to match a curvature of the roll, wherein the face is shaped to at least partially conform about a plurality of circular rolls, wherein the face edge of the top and the face edge of the bottom are straight, wherein the face edge of the top and the face edge of the bottom are parallel, and wherein the face edge of the first side and the face edge of the second side are shaped to match a curvature of at least a first roll, a curvature of a second roll, and a nip area.

7. The system of claim 4, wherein the viscous material delivery device is disposed within the housing and inserted through a vent, wherein the viscous material delivery device is inserted through a port disposed in the first side, the second side, the top, or the bottom of the housing, and wherein the viscous material delivery device further comprises:

a viscous material entry port disposed in the first side, the second side, the top, or the bottom; and a viscous material exit port disposed opposite the viscous material entry port, wherein the viscous material delivery device further comprises a plurality of nozzles, and wherein each of the plurality of nozzles is aimed toward the face of the housing.

8. The system of claim 1, further comprising a debris removal brush, the debris removal brush comprising one of: a static brush or a movable brush, wherein the movable brush comprises a rotary brush, an oscillating brush, or a vibrating brush.

9. The system of claim 1, wherein the plurality of seals comprises a top seal attached to a face edge of a top of the housing, a bottom seal attached to a face edge of a bottom of the housing, a first side seal attached to a face edge of a first side of the housing, and a second side seal attached to a face edge of a second side of the housing, and wherein, when each seal of the plurality of seals is in the first position, each seal is between an angle that is parallel to at least the surface and perpendicular to at least the surface.

10. The system of claim 1, wherein each gas delivery device of the plurality of gas delivery devices is configured to supply the gas at a velocity sufficient to move each seal of the plurality of seals into the second position, wherein each gas delivery device of the plurality of gas delivery devices is configured to supply the gas at a velocity sufficient to prevent a viscous material from passing through the gap when each seal of the plurality of seals is in the second position, wherein each gas delivery device of the plurality of gas delivery devices is a forced gas delivery device, and wherein the forced gas delivery device is an air knife.

11. The system of claim 10, wherein, when in an absence of supplied gas, each seal of the plurality of seals is in the first position and the viscous material is capable of flowing onto at least one of the seals of the plurality of seals, into the housing, through the housing, and into a drain.

12. The system of claim 11, further comprising a collection device, wherein the collection device is disposed at an exit of the drain, and wherein the collection device is a channel, a vacuum bar, or a sink.

13. The system of claim 1, wherein each seal of the plurality of seals is one of: a rigid seal or a flexible seal.

14. A method of containing a viscous material applied to a surface, comprising:

moving a system adjacent the surface, the system comprising:

a housing;

a viscous material delivery device;

a plurality of seals movable between a first position and a second position, wherein a contacting edge of each seal of the plurality of seals contacts the surface in the first position and is separated from the surface by a gap in the second position, and wherein the surface carries the viscous material toward at least one seal of the plurality of seals;

delivering the viscous material to the surface; and delivering gas from a plurality of gas delivery devices toward the contacting edge of each seal of the plurality of seals to move each seal of the plurality of seals into the second position where the contacting edge of each seal of the plurality of seals is separated from at least the one surface by the gap, wherein a velocity of the gas is sufficient to prevent the viscous material on the surface from passing through the gap and wherein, when each of the plurality of seals is in the second position, the gas supplied by the plurality of gas delivery devices is configured to maintain the viscous material within the housing by acting as a contactless seal between the housing and the surface.

15. The method of claim 14, wherein moving the housing adjacent to the surface comprises moving each seal of the plurality of seals into the first position to contact at least the surface, and wherein each seal of the plurality of seals is a flexible seal or a rigid seal.

16. The method of claim 15, wherein moving the plurality of seals into the first position to contact the surface further comprises biasing each seal of the plurality of seals toward the surface.

17. The method of claim 14, wherein delivering the gas by the plurality of gas delivery devices is performed by a plurality of forced gas delivery devices, wherein the plurality of forced gas delivery devices is a plurality of air knives, and wherein delivering the gas urges each seal of the plurality of seals to move into the second position.

18. The method of claim 14, further comprising removing the viscous material from the surface, wherein the surface is a moving surface, and wherein the moving surface carries the viscous material toward at least one seal of the plurality of seals.

19. The method of claim 14, wherein delivering the gas to prevent the viscous material from passing through each gap allows the viscous material to flow onto at least one of each seal of the plurality of seals and into the housing.

20. The method of claim 14, further comprising deactivating each gas delivery device of the plurality of gas delivery devices to move each seal of the plurality of seals into the first position, wherein, in the first position, the viscous material is permitted to flow over a seal of a bottom of the housing into the housing.

* * * * *